United States Patent [19]

Chelminski

[11] 3,958,647

[45] May 25, 1976

[54] POWERFUL SUBMERSIBLE DEEPWATER PILE DRIVER POWERED BY PRESSURIZED GAS DISCHARGE

[75] Inventor: Stephen V. Chelminski, West Redding, Conn.

[73] Assignee: Bolt Associates, Inc., Norwalk, Conn.

[22] Filed: June 4, 1975

[21] Appl. No.: 583,686

[52] U.S. Cl. ..... 173/127; 173/131; 173/135

[51] Int. Cl.[2] ..... E02D 7/00

[58] Field of Search ..... 173/127, 1, 2, 135, 173/138, 131; 61/53.5

[56] References Cited

UNITED STATES PATENTS

| | | | |
|---|---|---|---|
| 3,646,598 | 2/1972 | Chelminski | 173/1 |
| 3,721,095 | 3/1973 | Chelminski | 61/53.5 |
| 3,788,402 | 1/1974 | Chelminski | 173/127 |
| 3,817,335 | 6/1974 | Chelminski | 173/127 |
| 3,892,279 | 7/1975 | Amtsberg | 173/127 |

*Primary Examiner*—James A. Leppink
*Attorney, Agent, or Firm*—Parmelee, Johnson & Bollinger

[57] ABSTRACT

A very powerful pile driver is disclosed capable of operation in the air, partially submerged or totally submerged in the ocean for driving long piles into the ocean floor in deep water construction jobs. The pile driver includes a cylindrical housing, a movable massive weight within the housing, an annular cylindrical thrust-transferring member defining a discharge chamber below this weight, and a movable driving head attached to this annular member, forming a thrust-transmitting assembly adapted to be engaged with the pile. Pressurized gas such as compressed air is discharged from gas discharge apparatus, called an airgun located within the discharge chamber and provides two driving thrusts for each discharge. A cantilevered arm projecting from the gas discharge apparatus extends through and is straddled by an opening in the wall of the thrust-transmitting assembly and supports the cylindrical housing and feeds pressurized gas to the airgun which is temporarily in "floating" relationship during the instants when pile-driving thrusts are being transmitted, said arm engaging shock-absorbing means attached to the housing. Gas purging means enable seawater to be purged from the firing chamber of the airgun after the pile driver has initially been lowered into the sea in preparation for operation, and a position-responsive valve may be provided to monitor the operational relationships for protecting the equipment.

14 Claims, 10 Drawing Figures

12
68
72
56
64
66
74
14
145
34
73
130
129
84
148
30
151
55
150
146
102
29
14
80
126
127
28
20
128
138
145
16
143
142
26
162
158
18
33
36
21
156
152

12

54
145
56
72
34
73
74
140
68
130
64
66
148
73
84
150
30
151
129
55
141
146
102
29
20
14
102
127
147
28
141
80
138
16
145
128
143
26
19
162
142
158
33
36
156
152
21
18

PILE SUDDENLY DROPS OR OPERATOR PULLS UP ON CABLE

SHOCK ABSORBING SUPPORT CYLINDER LOSES FLUID

POWERFUL SUBMERSIBLE DEEPWATER PILE DRIVER POWERED BY PRESSURIZED GAS DISCHARGE

BACKGROUND OF THE INVENTION

This invention relates to a pile driver powered by pressurized gas discharge and, more specifically, to a pile driver capable of delivering powerful thrusts to the pile being driven while submerged in deep water such as is frequently encountered in offshore ocean operations.

An airgun repeater powered pile driver capable of driving piles of various types and sizes and which can be operated totally submerged, partially submerged, or entirely in air is disclosed in my U.S. Pat. No. 3,817,335. The pile driver of the present invention provides further technological advantages, including unique gas and water purging features. The pile driver of the present invention can be advantageously utilized for driving long piles of large diameter in deep water work, for example, in water up to several hundreds of feet in depth, where submersion is highly advantageous in enhancing the driving characteristics for long piles. A large powerful pile driver embodying the present invention is capable of driving very long, large diameter pipe piles into the ocean floor, for example pipe piles 400 feet long or even 600 feet long or more and up to 4 feet and larger in diameter. The structure of the powerful deepwater pile driver embodying the present invention permits the gas discharging apparatus, also called an airgun, to remain in "floating" relationship without rigid attachment to the thrust-transmitting assembly in the pile driver thereby minimizing any potentially harmful effects of shock on the airgun which is used to power the driver. Thus, the pile driver of the present invention provides an operating capability and a structural arrangement of pile driver elements which is uniquely different from as well as providing numerous advantages over the airgun repeater powered and other pile drivers presently known. Another airgun powered pile driver is shown in my U.S. Pat. No. 3,646,598 and an airgun powered thruster in my U.S. Pat. Nos. 3,604,519 and 3,750,609.

I have also invented a prior pile driver method and apparatus as shown in U.S. Pat. Nos. 3,714,739; 3,788,402; and 3,721,095, which I believe to be quite different in principle and operation from a pile driver embodying the present invention.

SUMMARY OF THE INVENTION

The powerful submersible pile driver according to the present invention includes, as a basic structure, three operative components within an elongated cylindrical housing. The three operative components include a massive cylindrical piston weight which can move up and down within the housing, a thrust-transmitting assembly (including an annular thrust-transferring member attached to a pile driving head), this assembly is also movable up and down within the housing beneath the piston weight, and a pressurized gas discharging apparatus positioned within the thrust-transmitting assembly intermediate the piston weight and the driving head and surrounded by said annular member which transfers a thrust down from the massive piston weight to the driving head. The annular cylindrical member surrounding the gas discharging apparatus defines a discharge chamber in which the pressurized gas discharging apparatus is relatively movably mounted without rigid attachment to any of the other operative components of the pile driver so that it is in "floating" relationship therein. An axially elongated opening in the wall of the thrust-transmitting assembly straddles an arm extending from the airgun defining a passageway through which the airgun communicates with the exterior of the pile driver and through which connections may be made, such as for feeding high pressure gas to the airgun.

The pressurized gas discharging apparatus or airgun suddenly and repeatedly discharges pressurized gas for generating an initial powerful thrust down upon the thrust-transmitting assembly and causing the massive weight above it to move upwardly. Through discharge passages, to be explained in detail hereinafter, the released high pressure gas, which may be intermixed with water in the discharge chamber, is permitted to escape, thus allowing the massive weight to move downwardly striking the intermediate annular member transmitting a second powerful thrust down upon the driving head and hence to the pile to be driven. Thus, two driving thrusts are obtained through each discharge of the pressurized gas from the airgun into the discharge chamber, the first driving thrust occurring when the pressurized gas is discharged and the massive weight moves upwardly while the thrust-transmitting assembly moves downwardly, and the second driving thrust occurring when the piston weight impacts down with respect to the thrust-transmitting assembly.

The cylindrical piston weight may advantageously contain a passageway communicating with the discharge chamber and with the ambient environment, for example the ocean or other body of water, surrounding the pile driver housing so that water may freely enter the discharge chamber when the pile driver is submerged. The presence of water in the discharge chamber results in a greater operational efficiency upon discharge of the pressurized gas into the chamber since water is almost incompressible as compared with the air which would otherwise occupy that chamber. A check valve is associated with the passageway within the weight, where it communicates with the discharge chamber, and is arranged either to permit water to enter the discharge chamber through the passageway in the weight or to seal the passageway during discharge of the pressurized gas. The check valve may advantageously be associated with a deflector surface which initially deflects discharged gas away from a purging passage in the piston weight. Since water entering the gas discharge chamber when the pile driver is initially lowered beneath the ocean may also undesirably enter the firing chamber of the gas discharge apparatus before it begins operation, purging means and advantageously provided for conducting pressurized gas to the firing chamber to purge water therefrom prior to charging of the chamber.

The pressurized gas discharging apparatus is in "floating" relationship within the annular member surrounding it, between the massive weight and the driving head so that the effects of this apparatus of mechanical shocks, due to the sudden and forceful movements of the weight, annular member and the driving head, are minimized. The discharge apparatus communicates with the exterior of the surrounding annular member and the pile driver cylindrical housing through a cantilevered arm rigidly connected to the discharge apparatus and passing through an axially elongated opening in the wall of the intermediate annular member. Through this arm may pass lines for supplying high pressure gas, for transmitting control signals if desired, and for monitoring operation, and the like.

High pressure gas, usually compressed air, may be supplied at an operating pressure in the range from 100 pounds per square inch (p.s.i.) up to 3,000 p.s.i. or more, from a suitable source such as a compressor located on board a ship or barge or on a platform or from compressed air storage tanks which may be mounted directly on the pile driver housing itself. Even higher gas pressures may be employed, if desired. The term "high pressure gas" or "pressurized gas" as used herein is intended to include compressed air, compressed carbon dioxide, compressed nitrogen, or any other pressurized vapor or gas which may be used in an airgun as illustrated herein.

The potentially harmful effects of mechanical shocks on the free floating airgun may be advantageously further minimized by damping piston means associated with the end of the cantilevered arm. Such a damping piston is slidable within a cylinder containing shock-absorbing or motion damping fluid, with this cylinder being rigidly mounted to the pile driver housing.

The pressurized gas discharging apparatus may be an airgun repeater such as is described in my U.S. Pat. Nos. 3,249,177, 3,310,128 and 3,379,273 and may be repetitively actuated through transmission of an electric signal to solenoid valve structure for actuation, such as is described in U.S. Pat. No. 3,588,039 or may be self-actuating as is described in my U.S. Pat. Nos. 3,379,273 or 3,707,848.

Accordingly, among the features of this invention is the provision of an improved powerful pile driver which is powered by pressurized gas discharging apparatus and is capable of operation in the air, partially submerged or totally submerged in deep water.

An advantage of a pile driver embodying this invention is that the gas discharging apparatus may be effectively structurally independent from the thrust-transmitting and thrust-receiving elements of the pile driver to minimize potentially harmful shock effects.

Among the further advantages of a powerful pile driver embodying this invention is that it is capable of convenient operation when submerged in deep water such as is found in offshore construction jobs and possessing water and gas purging and other features as described herein making it particularly advantageous for such deepwater jobs.

So far as I am aware this invention provides the most powerful pile driver in the world capable of operating fully submerged in the ocean for driving long piles into the ocean floor, for example such as steel pipe piles up to 400 feet or even up to 600 feet and longer in overall length and up to 4 feet in diameter and larger.

The various features, aspects and advantages of the pile driver of the present invention will become more fully appreciated from a consideration of the detailed description of a preferred embodiment thereof taken in conjunction with the accompanying drawings, in which:

DESCRIPTION OF THE PREFERRED EMBODIMENT

Figure 1:
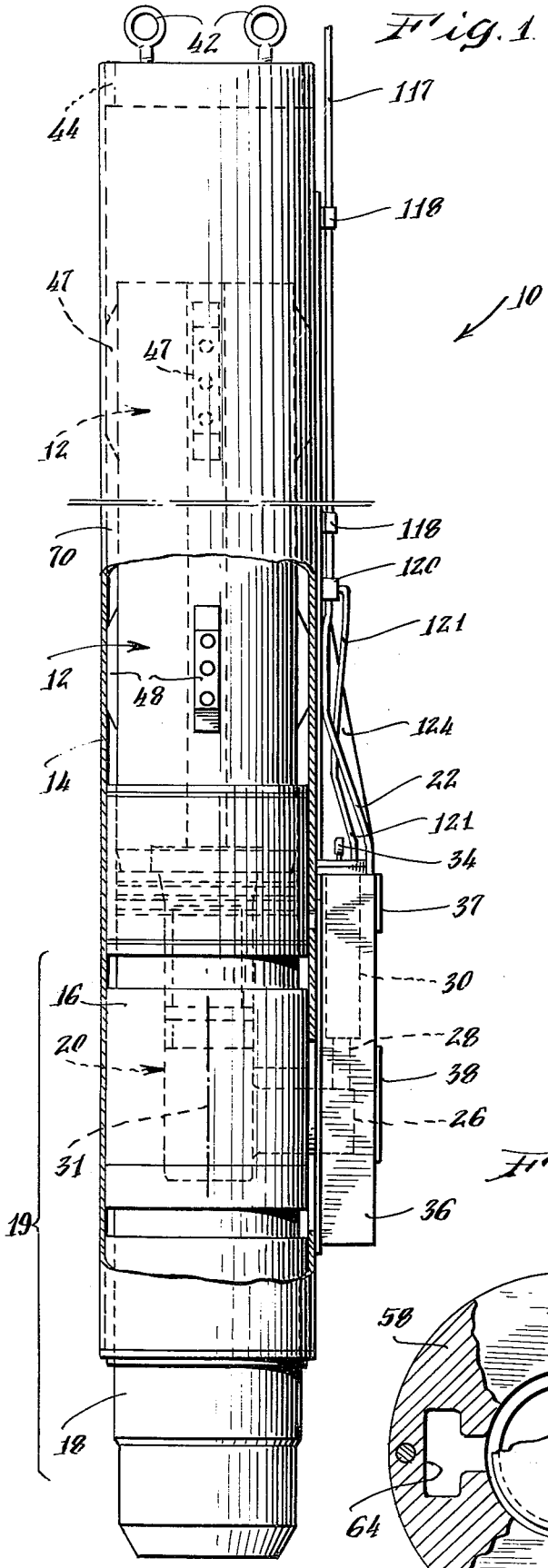
FIG. 1 is a longitudinal front view, partly in section, of a pressurized gas-discharge powered pile driver embodying the present invention.
Figure 2:
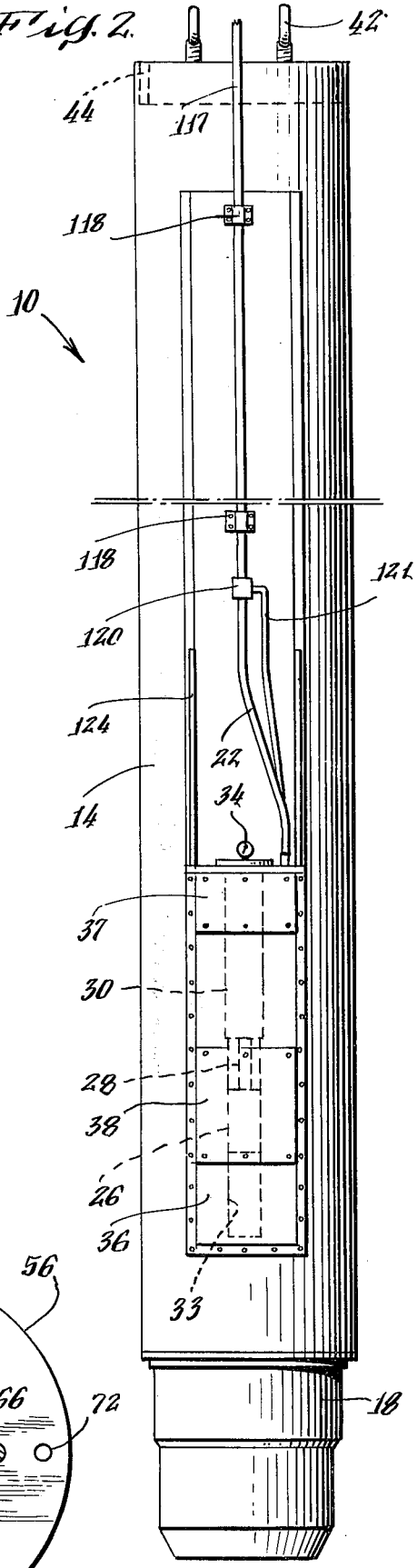
FIG. 2 is a longitudinal side view of this pile driver of FIG. 1 as seen looking at FIG. 1 from the right.
Figure 3:
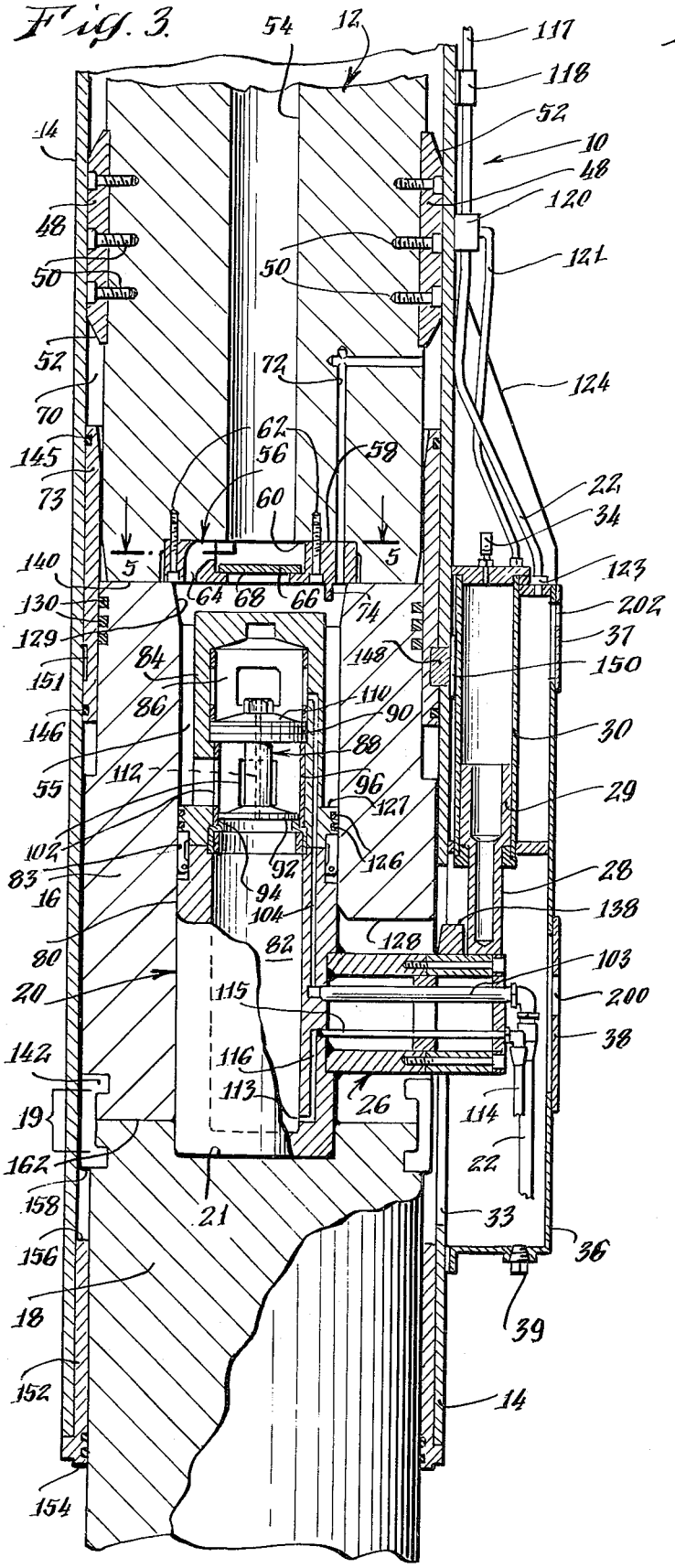
FIG.3 is an enlarged elevational section view of the lower central portion of the pile driver of FIG. 1 showing the cooperative relationship of the various operative components and their details of construction.

Referring to FIGS. 1–5, there is shown a pile driver 10 which includes a massive cylindrical weight 12 which is movable up and down within an elongated cylindrical housing 14 for delivering thrusts to a movable annular thrust-transferring member 16 and thence to a driving head 18, both of which are also movable with respect to the cylindrical housing 14. The annular member 16 and the driving head 18 are securely attached to each other as shown in FIG. 3, thereby forming a movable thrust-transmitting assembly 19. The driving head 18 may drive any type of drivable pile, such as a pipe pile, H-beam pile, timber pile and the like, through the use of known driving adapter means, as disclosed, for example, in my U.S. Pat. No. 3,817,335. A very large pile driver embodying this invention when operating fully submerged is capable of driving very long, large diameter, pipe piles into the ocean floor such as pipe piles up to 400 feet or even up to 600 feet long or more and 4 feet or larger in diameter.

Figure 6:
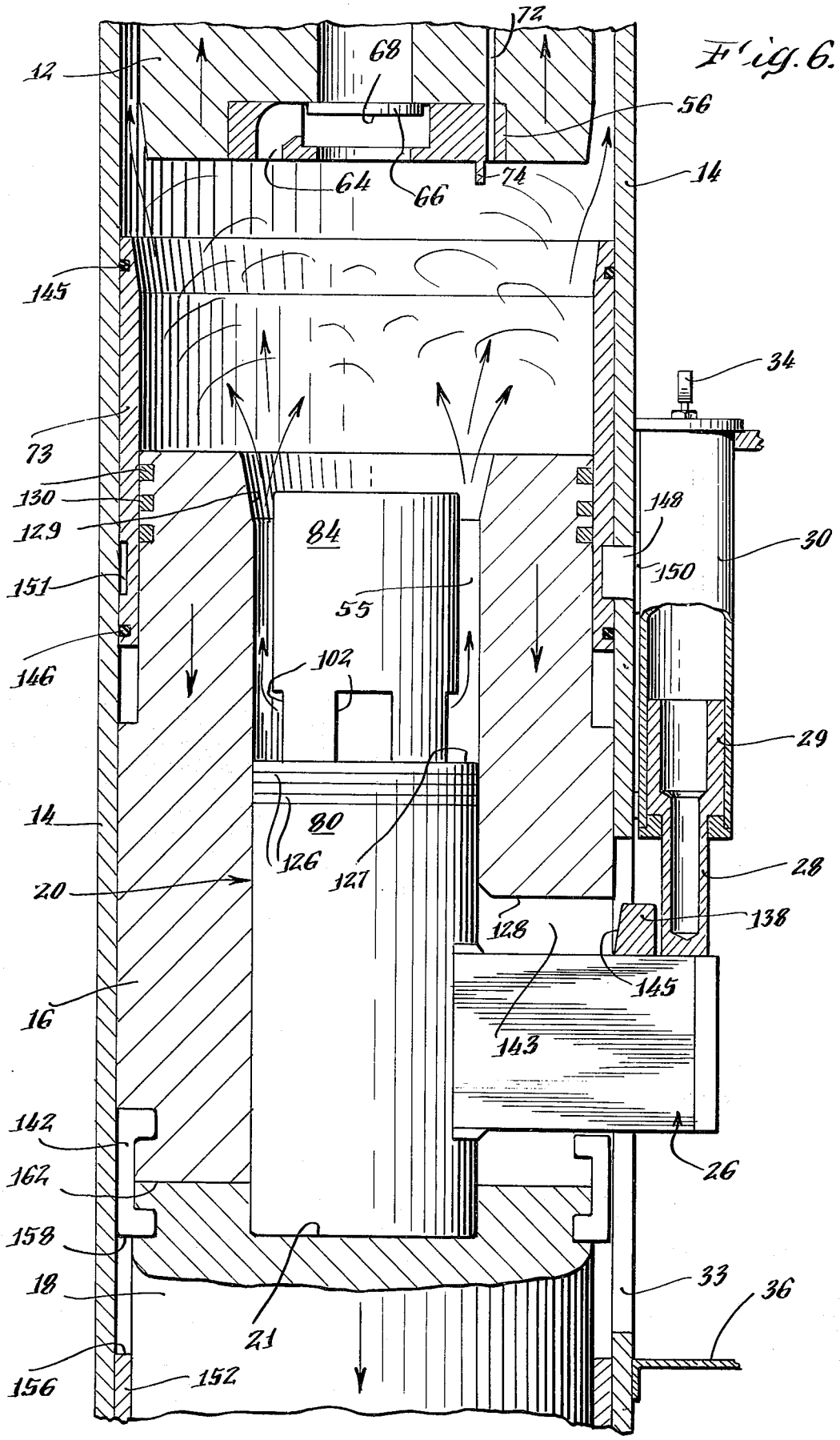
FIG. 6 is a further enlarged sectional view of the central portion of FIG. 3 showing the operating position of the components when the abrupt discharge of pressurized gas has occurred.

Relatively movably mounted with respect to the transmitting assembly 19 is the pressurized gas discharging apparatus 20. This pressurized gas discharging apparatus 20 may advantageously be of the type described in my U.S. Pat. Nos. 3,310,128 and 3,379,273 and referred to therein as an "airgun repeater"; herein it is called an airgun. This airgun 20 is repetitively actuated to abruptly release a charge of very high pressure gas, for example, compressed air, causing the massive weight 12 to move upward, as shown in FIG. 6, and producing powerful pile driving thrusts as will be explained further below in connection with FIGS. 6 and 7.

Figure 4:
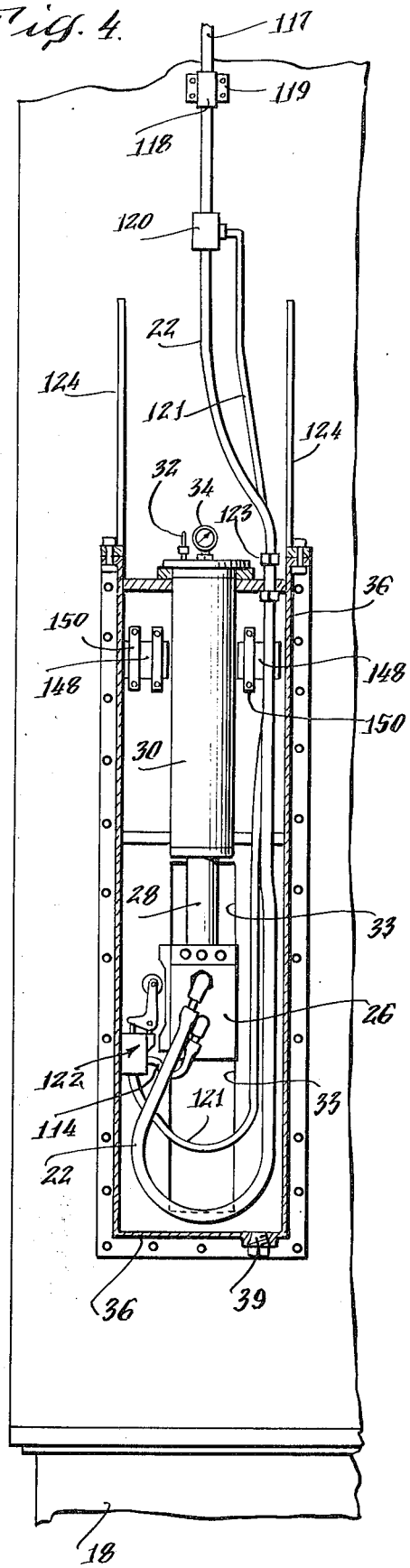
FIG. 4 is an enlarged side elevational view, partly in section, as seen looking at the right side of the portion of the pile driver shown in FIG. 3, illustrating further details of construction.

The pressurized gas for the gas discharging apparatus is supplied through a high pressure supply line 22, seen best in FIGS. 3 and 4, connected to a suitable source of pressurized gas, such as an air compressor located on a ship, barge, platform, or other suitable support.

The pressurized gas discharging apparatus 20 is in "floating" relationship with respect to the impulse transmitting assembly and normally rests down into a cavity 21 (FIG. 3) in the driving head 18, and communicates with the exterior of the elongated cylindrical housing 14 by means of a rigidly attached laterally extending cantilever arm 26. This arm 26 is associated with a piston rod 28 connected to a shock-absorbing piston 29 mounted within a shock absorbing cylinder 30, seen best in FIG. 3. This cylinder 30 is secured to the housing 14. The lower end of the piston rod 28 normally rests down upon the airgun arm 26.

Thus, normally, the weight of the whole housing 14 and attachments thereto are supported upon the shock absorber means 30, 29, 28 comprising the fluid-filled cylinder and piston and rod, because the piston rod 28 normally rests down on the airgun arm 26 while the airgun is normally resting down in the cavity 21 in the pile driving head 18 which in turn is engaged with the pile (not shown) which is being driven.

Pressurized gas is initially introduced through a gas fill valve 32 (FIG. 4) into the cylinder 30 to serve as a shock-absorbing medium, and the pressure of this gas may be shown on a waterproof gage 34 (FIG. 4). In order to reduce the mass of the piston rod 28 and piston 30, they are made hollow, as seen in FIG. 3, thereby reducing the off-axis inertial loading on the cantilevered arm 26 with respect to the vertical axis 31 (FIG. 1) of the airgun 20.

The cantilevered airgun arm 26 has a rectangular cross-sectional shape, as seen most clearly in FIG. 4, having its thicker dimension extending vertically so that this arm 26 is very rigid in the vertical (axial) direction. This arm 26 projects radially out through an axially elongated clearance opening 33 (FIGS. 3 and 4) in the cylindrical housing 14 of the pile driver 10.

As seen in FIGS. 1, 2 and 4, the pressurized gas supply line 22 and the shock absorber cylinder 30 are mounted on the exterior of the pile driver housing 14. The pressurized gas discharging apparatus 20 and its laterally extending arm 26 as well as the shock absorber means 28, 29, 30 are protected by means of an enclosure 36, having removable cover plates 37 and 38, as seen in FIGS. 1, 2 and 3 for access thereto, and having a removable drain plug 39 (FIGS. 3 and 4).

The pile driver 10 embodying this invention is particularly suitable for driving large piles while completely submerged, for example for use in deep water operations. As shown in FIGS. 1 and 2, the pile driver 10 is provided with a plurality of lifting eyes 42 connected to a heavy steel collar ring 44 secured to the upper end of the housing 14. The support collar 44 may be fixedly secured to the pile driver housing 14 by means of miltiple fastening bolts or the like. Thus, the pile driver 10 may be suspended from the top by means of a cable and bridle sling supported from a crane, not illustrated, on a barge, ship or tower platform.

The main operative components of the pile driver 10 are shown in greater detail in FIGS. 3 and 4. Referring to FIG. 3, the massive cylindrical weight 12 is seen to be movably mounted within the cylindrical housing 14. Spaced about the periphery of the weight 12 are a plurality of vertically elongated guide shoes 48 which are secured to the weight 12 by means of the machine screws 50. The guide shoes 48, for example four in number, are located at spaced positions around the weight 12 and have upper and lower end surfaces tapered, as shown at 52. There are a similar group of guide shoes 47 (FIG. 1) spaced about and secured to the upper end of the massive weight 12.

These guide shoes are fabricated from or are covered with a bearing material which will be compatible with the material of the housing 14 in order to provide a proper slidable bearing relationship between the two. For example, when the cylindrical housing 14 is made of steel, the guide shoes 47 and 48 may be covered with bronze bearing material. Thus, the guide shoes 47 and 48 absorb most of the wearing action and may be removed and replaced when they become worn out. The massive weight 12 is movable not only vertically within the housing 14 but also rotationally with respect thereto since it is not rigidly attached to any of the other members. Consequently, the guide shoes 47 and 48 may be adapted to allow a rotational movement of the massive weight 12 to occur so that a more even wear of the housing 14 is obtained.

Axially extending within the massive weight 12 is a passageway 54 (FIG. 3) communicating at its upper end with the environment surrounding the pile driver 10 and at its lower end with the internal chamber 55 (FIG. 3) formed by the annular impulse transmitting member 16. As will be explained in greater detail hereinafter with reference to operation of the pile driver, this passageway 54 permits the flow of water, when the pile driver is submerged, from the exterior of the pile driver to the interior of the discharge chamber 55.

Figure 5:
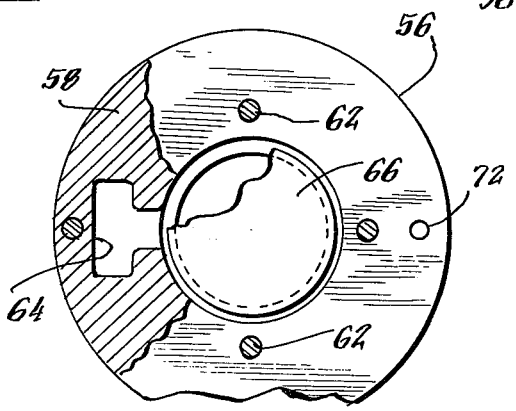
FIG. 5 is an enlarged cross-sectional view taken along the plane 5—5 in FIG. 3.

Positioned within a socket in the lower end of the massive weight 12, at the location here the passageway 54 communicates with the discharge chamber 55 there is a valve assembly 56 (FIG. 3), a cross section of which is shown in FIG. 5. The valve assembly means 56 includes a valve seat 58 anchored within the socket 60 within the weight 12 by means of the machine screws 62. The valve seat 58 has a lateral passageway 64 which provides communication between the axial passageway 54 in the weight 12 and the discharge chamber 55.

A disc-like valve element 66 (FIG. 3) is movable within the valve seat 58 to seal the passageway 54 when pressure is applied to its lower surface 68 urging it up against the end of the passageway 54 to seal it in check valve fashion. The upper surface of the valve disc 66 facing the passageway 54 may be crowned slightly in order to seat well against the lower end of the passageway 54.

Also located within the weight 12 is a gas purge passage 72 (FIG. 3) through which gas mixed with some water may be expelled after the pressurized gas discharging apparatus 20 has released high pressure gas to provide the initial and second pile-driving thrusts, as will be explained further below.

As shown in FIG. 6 the sudden discharge of the gas applies a force acting up against the weight 12 and down against the whole cross sectional area of the thrust-transmitting assembly 19, thus initially thrusting down upon the driving head 18. The force up against the under surface 68 of the valve disc 66 seals the passageway 54, and the weight 12 is raised as shown in FIG. 6. After the lower end of weight 12 has risen beyond the accelerator sleeve 73 (FIG. 6), the discharged gas mixed with water can pass up through the annular space 70 between the weight 12 and the inner surface of the cylindrical housing 14. The guide shoes 48 and 47 (FIG. 1) are relatively widely spaced, and so they do not significantly block the upward progress of the escaping gas which passes out of the open top of the cylindrical housing 14.

After much of this gas has escaped from beneath the weight 12, it falls down heavily (FIG. 7) upon the annular thrust-transmitting member 16 imparting a second downward thrust to the driving head 18.

The interior cavity of the annular thrust-transmitting member 16 defines the pressurized gas discharge chamber 55, as mentioned above. Located within this discharge chamber 55 and extending down within the cavity 21 formed within the top of the driving head 18 is the pressurized gas discharging apparatus 20. This airgun 20 includes a lower housing 80 (FIGS. 3 and 6) defining a firing chamber 82 (FIG. 3) connected by clamp ring 83 to an upper housing 84 containing an operating cylinder 86. It is to be understood that the pressurized gas discharging apparatus 20 may be similar to those airguns disclosed in the aforementioned patents, particularly of the self-firing type shown and described in my U.S. Pat. Nos. 3,379,273 and 3,707,848. For the purposes of the present specification the following brief description of the illustrated airgun 20 and of its operating principles is believed to be sufficient. The reader may refer to those patents if further information is desired about such gas discharging apparatus for suddenly releasing pressurized gas in an abrupt, forceful discharge.

Operatively associated with the firing chamber 82 and the operating cylinder 86 is a shuttle 88 slidably mounted in a partition 90. This shuttle includes a lower release piston 92 and an upper operating piston 110. When the shuttle 88 (FIG. 3) is in its normal position prior to the discharge of pressurized gas, its release piston 92 is in sealing engagement with a seal ring 94 so as to maintain a charge of pressurized gas in the firing chamber 82.

A release cylinder sleeve 96 defines a release cylinder surrounding the release piston 92. This release cylinder contains a plurality of ports 102 through which the pressurized gas will be very suddenly discharged after a fast upward movement of the shuttle 88 for exposure of the ports 102 by the release piston 92. In preparation for release of pressurized gas, such as compressed air, the pressurized gas is introduced through the supply line 22 (FIG. 3) and through feed passageway 103 in the arm 26 and then through passageway 104 located in the wall of the lower and upper housings 80 and 84. The pressurized gas enters the operating cylinder 86 from the upper end of passageway 104. Within the operating cylinder 86 is the operating piston 110 of the shuttle 88.

The pressurized gas enters the firing chamber 82 by flowing down through a constricted axial passageway 112 (FIG. 3) within the hollow piston rod of the shuttle 88 which connects the release piston 92 with the operating piston 110. As the pressurized gas flows into the cylinder 86, the constriction of passage 112 briefly maintains the pressure in the cylinder 86 above the pressure in the firing chamber 82. After the firing chamber 82 is filled to the desired pressure the airgun 20 is ready to discharge the pressurized gas. This may be accomplished by providing a solenoid valve as dicslosed in the U.S. Pat. Nos. 3,588,039 and 3,707,848 or by making the airgun automatically self-firing as also disclosed in my U.S. Pat. Nos. 3,379,273 and 3,707,848.

The airgun 20 is made self-firing by providing an effective area of the release piston 92 exposed to the pressurized gas in the firing chamber 82 greater than that of the operating piston 110 exposed to the pressurized gas in the cylinder 86. Accordingly, when the pressure in the firing chamber 82 has risen up substantially to that in the cylinder 86, the shuttle begins moving upwardly and the sealing condition of the operating piston 110 becomes open to allow the high pressure gas in the chamber 86 to communicate with the lower face of the operating piston 110. The shuttle 88 is accelerated upwardly and abruptly opens the ports 102 to release suddenly the pressurized gas, providing a sudden abrupt increase in pressure within the discharge chamber 55. After discharge, the gas remaining trapped in the operating cylinder 86 is compressed by the fast-traveling operating piston 110, thus serving to decelerate the shuttle 88 and to return it to its initial position as shown in FIG. 3.

Although the gas discharge apparatus 20 may be such as is described in the aforementioned patents, the present apparatus 20 has an advantageous feature permitting purging of water from the firing chamber 82. This water may enter and fill the airgun 20 when the pile driver is initially submerged and before the airgun 20 is placed in operation. Thus, there is provided, as seen in FIG. 3, a purging line 114 which is shown as being of smaller diameter than the main supply line 22. This purge line 114 connects through a passage 115 in the arm 26 directly into a passage 116 leading into the port 113 in the bottom region of the firing chamber 82.

The pressurized gas for charging the airgun 20 and for purging it is supplied through a main pressure hose line 117 (FIG. 2) which is secured to the housing 14 of the pile driver by short lengths of chaffing tube 118 held by clamp brackets 119 (FIG. 4) which are attached to the housing 14. The main pressure line 117 feeds into a Tee connection 120 which leads to the beginning of the supply line 22. The Tee connection 120 also leads into a branch line 121 which is connected into a purge and control valve assembly 122 (FIGS. 4, 8, 9 and 10). Both the supply line 22 and the branch line 121 enter into the upper end of the enclosure 36 through fittings shown at 123 (FIG. 4). The side plates of the enclosure 36 may taper inwardly above the region where the gas fill valve 32, gage 34 and fittings 123 are located. This taper of the side plates is seen in FIG. 3 at 124. The purge and control valve assembly 122 is shown in detail in FIG. 8. One of its purposes is to allow water to be purged from line 114 and from the gas discharging apparatus 20.

The pressurized gas discharging apparatus 20 advantageously is in axially floating relationship within the discharge chamber 55 and the cavity 21 formed within the driving head 18, for this discharge apparatus 20 is not fixed to any of the internal elements within the cylindrical housing 14. The discharge apparatus 20 is thus permitted to move axially relative to the discharge chamber 55. The slack loops in the flexible hose line 22 and 121 (FIG. 4) within the enclosure 36 freely accomodate any relative motion between the pile driver housing and the gas discharge apparatus 20.

A seal is maintained with the walls of the discharge chamber by means of a plurality of piston rings 126 surrounding the airgun 20 below the level of the discharge ports 102. The outside diameter of the airgun 20 is reduced (as seen in FIG. 3) by a shoulder 127 above the location of the piston rings 126 so as to provide an annular clearance space around the discharge ports 102 and around the entire upper housing 84 of the airgun. This annular clearance space is part of the discharge chamber 55 which continues up toward the lower end of the weight 12. The piston rings 126 prevent the discharged gas from leaking down around the airgun 20.

The arm 26 extends through an axially elongated opening 128 in the thurst-transmitting assembly 19 which "straddles" the arm. This opening 128 is aligned with the opening 33 (FIG. 4) in the pile driver housing 14. In addition to providing a communication means for containing the supply and purge lines 103 and 115 for operating the discharge apparatus 20, the arm 26 provides a connection with the shock absorber means 30, 29, 28 to damp the movement of the discharge apparatus 20 and to minimize potential harmful effects of shock arising from the thrusts of the pile driver elements. Also, the pressure of the gas within the shock absorbing cylinder 30 presses down on the piston 29 so as to urge the gas discharging apparatus 20 downwardly relative to the thrust-transmitting member 16. Thus, the whole housing 14 and its attachments are held up away from the upper side of the arm 26 as shown in FIG. 3.

Upon the sudden dischaarge of pressurized gas, the massive weight 12 is thrown upwardly by the abrupt rise in pressure in the discharge chamber 55, and at the same time a downward thrust on the thrust-transmitting assembly 19 is exerted by this pressure rise. The accelerator sleeve 73 closely surrounds and effectively seals the space around the lower end of the weight 12 beneath the lower guide shoes 48. Thus, as the weight 12 is thrown upward away from the annular member 16, the released pressurized gas acts over the entire lower end of the weight 12 for exerting a great total upward thrust on the weight. The upper portion of the discharge chamber 55 is flared outwardly at 129 for aiding in blasting the discharged gas up against the bottom of the massive weight 12, and also this flare provides communication with vent passage 72. The discharged gas also exerts a great total downward thrust upon the thrust-transmitting assembly 19. That is, the discharge gas gives a first down thrust to drive the pile when this gas is suddenly released through the ports 102 into the discharge chamber 55 and entering into the region below the lower end of the rising weight 12 and above the top of the thrust-transmitting assembly 19. There are piston rings 130 surrounding the upper end of the annular member 16 engaging the accelerator sleeve 73 for preventing gas leakage down around the annular member 16.

After the lower end of the weight 12 has traveled up beyond the accelerator sleeve 73, as shown in FIG. 6, then the discharged gas mixed with water can escape up through the annular space 70 around the weight 12 and out of the top of the pile driver housing 14. The pull of gravity slows down the upward travel of the weight 12 and then accelerates this weight downwardly toward the member 16.

Figure 7:
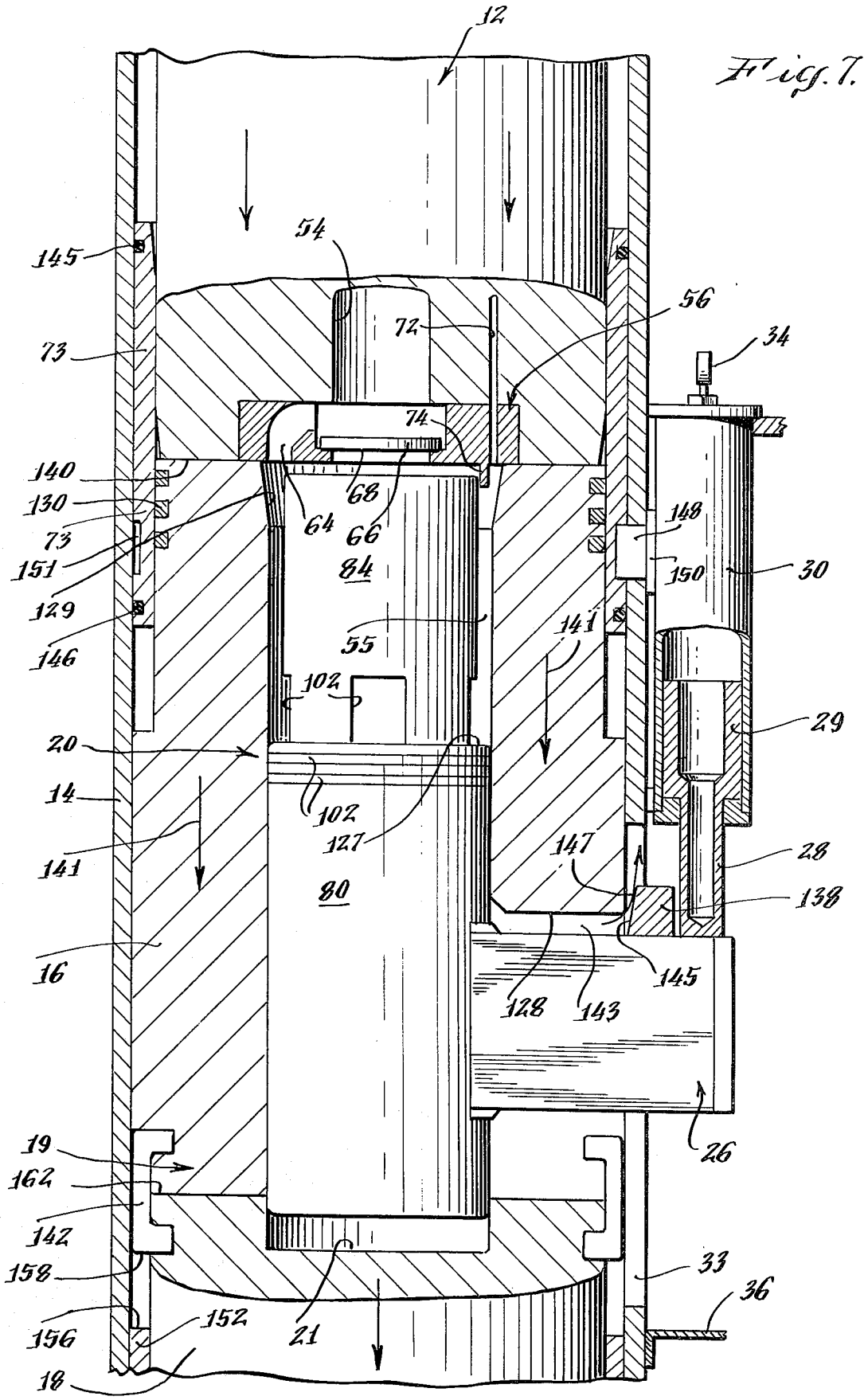
FIG. 7 is a view similar to FIG. 6 showing the operating positions of the components occurring soon after the moment shown in FIG. 6.

When this massive weight 12 strikes down, as shown in FIG. 7, upon the member 16 by making surface contact therewith at the area indicated at 140, a second downward thrust is provided to drive the pile. If desired, these contact surfaces 140 may be made of tough hardened steel. On being struck (FIG. 7), the thrust-transmitting member 16 transmits this second thrust 141 to the driving head 18. The thrust-transferring member 16 is rigidly assembled in end abutting relationship to the driving head 18 by means of a clamp ring indicated at 142, thus forming the thrust-transmitting assembly 19.

When the weight 12 impacts down upon the thurst-transmitting assembly 19, the shock-absorbing means 30, 29, 28 allows the airgun 20 to lag behind the sudden downward movement 141. In other words, the airgun 20 is protected from undue mechanical shock, and momentarily it is "floating" away from the descending cavity bottom 21. Water becomes trapped in the region 143 (FIG. 7) above the arm 26 and below the descending upper end of the opening 128. This trapping or snubbing effect is enhanced by the upward projection 138 on the arm which has a sloping inner shoulder surface 145 converging downwardly toward the exterior of the assembly 19. Accordingly, the escape 147 of the trapped water is progressively more restricted as the assembly 19 descends relative to the arm 26. The resultant increasing pressure of the trapped water in the region 143 exerts an increasing force to urge the airgun 20 downwardly without any sudden undue shock.

After the massive weight 12 has descended and delivered the second thrust 141, then the remaining released gas is removed from the discharge chamber 55. Water flows down the axial passage 54, past the now open check valve 56 and down through the passage 64 into the chamber 55. This entering water displaces the remaining gas which exits through the outlet passage 72. There is a baffle 74 extending down from the valve seat 58 near the mouth of the outlet 72 located between the outlet 72 and the axis of the chamber 55. The purpose of this baffle is to deflect the incoming water away from the outlet 72 to facilitate the rapid removal of gas. It is to be noted that the water inlet passage 64 enters at one side of the top of the discharge chamber 55 while the gas vent 72 is at the other side.

If it is desired to operate the pile driver 10 partially submerged or in the air, then water is pumped into the top of the passage 54 for filling and refilling the discharge chamber 55. The accelerator sleeve 73 is maintained fixed in place relative to the pile driver housing 14 by means of a plurality of keys 148 (see FIG. 4) each fitting within an opening in the housing 14 and engaging a circumferential channel 151 in the sleeve 73. Removable straps 150 permit the key 148 to be extracted so that the accelerator sleeve 73 may be removed and replaced. There are seals 145 and 146 surrounding the ends of this sleeve 73.

A sleeve bearing 152 (FIG. 3) guides the driving head 18, with sealing and lubricating rings 154 engaging the surface of the driving head. To prevent the driving head from moving too far downward when the pile driver is suspended and not in operation a stop surface 156 is provided on the sleeve 152. This stop surface 156 will support the annular shoulder 158 on the thrust-transmitting assembly 19. A grease fitting may be provided for lubricating the rings 154.

The time intervals between each pressurized gas discharge, when the airgun is self-firing, is controlled by the rate of filling of the firing chamber 82 by pressurized gas, which may be controlled by a constriction in the shuttle passage 112 previously referred to and disclosed and described in the aforementioned patents. Alternatively, a solenoid control valve can be utilized as there described. It is preferred to make the gas discharge apparatus 20 self-firing because this simplifies the pile driver by avoiding the use of an electrical control circuit.

In the embodiment of the pile driver illustrated, the massive weight 12 is of a weight of 10 tons or more, for example 60,000 pounds, for effectively driving large piles with powerful thrusts and in a submerged condition. For example, in this illustrative embodiment the weight 12 is 36 inches in diameter and eighteen feet long, being of solid steel except for the axial passage. During operation of the pile driver, the discharge device 20 is charged with compressed gas, usually compressed air at high pressures ranging from 100 p.s.i. up to 3,000 p.s.i. although higher pressures may be utilized. The actual pressure employed depends upon the size of the gas discharge apparatus 20 as well as the size of the massive weight, the size of the pile and the characteristics of the earth material into which the pile is being driven, and this pressure provides a convenient parameter for control of the pile driving operation.

It is to be noted that the annular member 16 and the driving head 18 are assembled together rigidly by the ring clamp 142 to form the thrust-transmitting assembly 19. The annular member 16 can be made longer and the driving head 18 can be correspondingly shorter. Conversely, the side walls of the driving head 18 can be extended up further such that the joint 162 between the annular member 16 and the driving head 18 is above the arm 26. In this case the elongated opening 128 is made in the wall of the driving head. Thus, it is to be understood that the joint 162 may be located at any desired level so long as the clamp 142 will not encounter the accelerator sleeve 73 or the sleeve bearing 152 and so long as the elongated opening 128 extends to this joint 162 so that the airgun 20 with its arm 26 can be inserted into the chamber 55. If desired, the annular member 16 and the driving head 18 can be made as an integral one-piece assembly, if the arm 26 is removably rigidly attached to the airgun 20.

Figure 8:
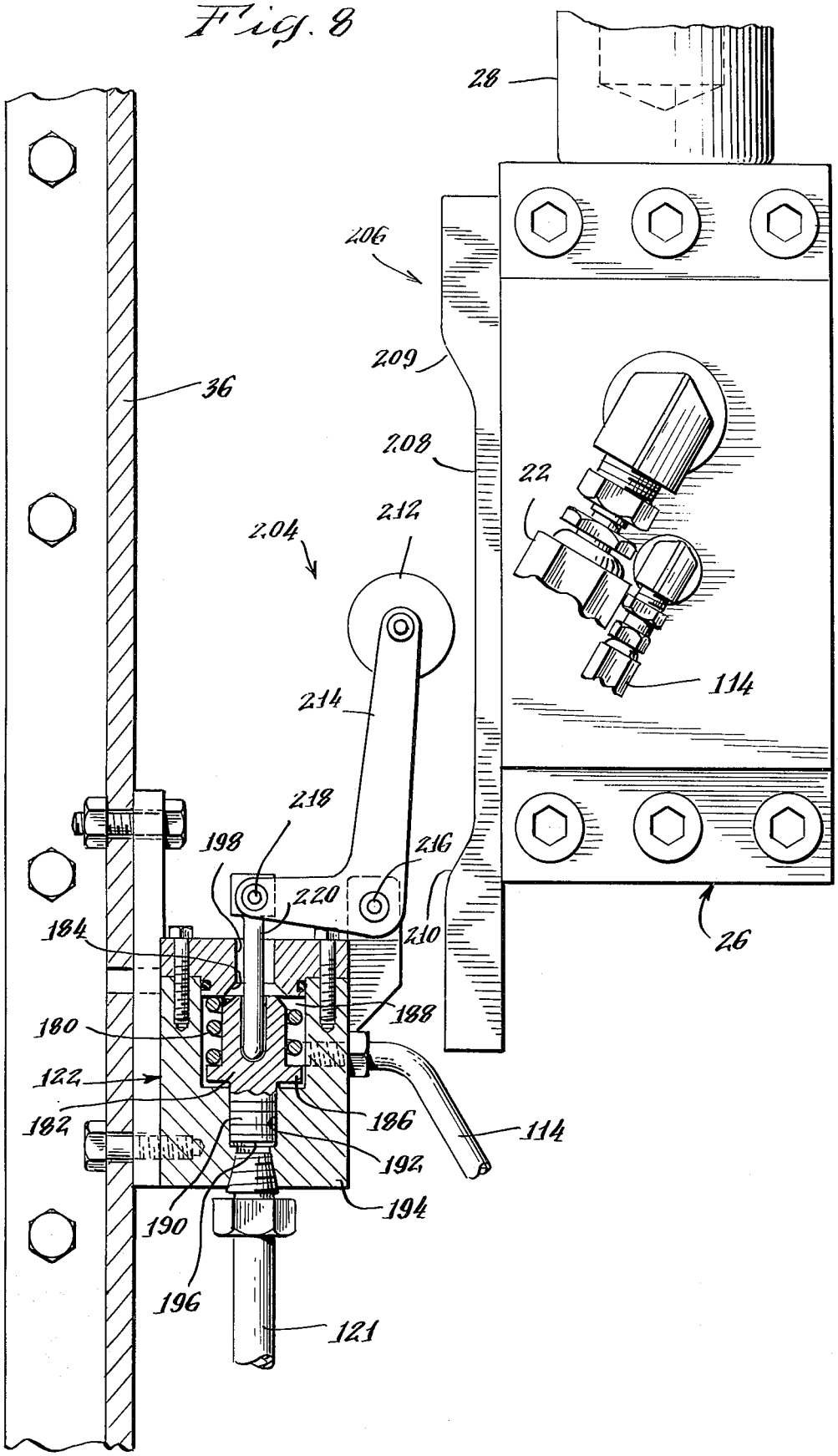
FIG. 8 is an enlarged elevational and partial sectional view of a pressure-responsive purging valve which may also be arranged to be position-responsive for monitoring the operational relationship of the components.

In order to explain the operation of the water purging system, attention is invited to FIGS. 3, 4 and 8. The purging and control valve assembly 122 contains a spring 180 urging a movable valve element 182 away from its seat 184. This spring presses against an annular shoulder 186 on the valve element 182 while the other end of this spring presses against the end of the valve chamber 188. The branch line 121 extends from the Tee connection 120 (FIG. 4) and communicates with the head 196 of a piston 190 at the opposite end of the valve element 182 from the seat 184 and located within a cylinder bore 192 in the valve casing 194. The purge line 114 communicates with the valve chamber 188, and there is an outlet passage 198 extending from the valve seat 184 out of the valve casing 194.

When the pile driver 10 is lowered down under water, the ambient water pressure progressively increases with depth. For example, if the pile driver is located 100 feet below the ocean surface, the ambient pressure is approximately 50 p.s.i. At a depth of 200 feet below the surface, the ambient pressure in the water is approximately 100 p.s.i. In other words, the water pressure increases approximately one p.s.i. for every 2 feet of depth below the surface. The spring 180 is sized relative to the area of the piston head 196 to hold the valve element 182 away from seat 184 until the pressure in line 121 significantly exceeds the ambient water pressure at the deepest intended operating depth. The pressure in branch line 121 (and in main line 117) which will overcome the spring force so as to close the valve 122 is called the "closing" pressure. It is desirable that there be a significant difference between the closing pressure and the ambient water pressure so that the operator can supply an intermediate (i.e. "purging") pressure for purging water from the gas discharging apparatus 20. For example, assume that the pile driver 10 is intended to operate at depths down to 400 feet below the surface, i.e. at ambient water pressures up to approximately 200 p.s.i., then the spring 180 may be sized to withstand a pressure of approximately 350 p.s.i. (the "closing" pressure) acting on the piston head 196 before the valve 122 closes.

In operation, the pile driver 10 is lowered into the water to its operating position without applying any significant gas pressure through the main supply line 117. The gas discharge apparatus 20 becomes filled with water. When the operating depth is reached, gas, usually air, at an intermediate "purging" pressure is fed through the line 117. This intermediate pressure is at a value, for example such as 250 p.s.i., which is above the ambient water pressure and below the "closing" pressure. This intermediate pressure is supplied for approximately 4 to 5 minutes, and the purging air flows from the main supply line 117 through line 22, connection line 103, and through passage 104, into the upper (operating) cylinder 186, so that the gas discharge apparatus 20 begins to will with air commencing in upper cylinder 86. This entering air presses down upon the water located within the apparatus 20 forcing the water out through the purging port 113 (FIG. 3), passage 116, and through lines 115 and 114 leading into the valve chamber 188. Accordingly, the water flows out of the apparatus 20 into the valve chamber 188 and then past the open valve seat 184 and escapes out through the outlet passage 198. The purged water escapes from the interior of the enclosure 36 through a port 200 (FIG. 3) in the cover 38 or a vent 202 in the cover 37.

The airgun 20 can not fire so long as the purging and control valve assembly is in its open position, as shown in FIG. 8, because the air in the firing chamber 82 can continue to escape through the purging port 113.

After 4 or 5 minutes of purging, the operators are assured that the airgun 20 is emptied of water and is thus ready to operate.

In order to prepare the pile driver apparatus for operation, the air pressure in main supply line 117 is raised from the intermediate or "purging" value up to a level above that necessary for closing the valve 122, for example, up to approximately 400 p.s.i. or more. Then the movable valve element 182 is forced against its seat 184 by the gas pressure acting against the cylinder head 196 and the pile driver commences to operate as soon as the firing chamber 82 has become fully pressurized.

In order to monitor the position of the pile driver housing 14 relative to the arm 26 of the gas discharging apparatus 20, position sensing means 204 are provided for monitoring their relative positions. This position sensing means 204 includes a double-ended linear cam 206 shown mounted on the arm 26 and having a low straight central cam surface 208 and inclined raised upper and lower surfaces 209 and 210. The position sensing means 204 also includes a cam follower roller 212 mounted on one end of an L-shaped lever 214, which has its elbow pivotally mounted at 216 on the valve casing 194. The other end of this lever 214 is pivoted at 218 to a plunger rod 220 which engages in a socket in the movable valve element 182.

The normal operating position is for the follower roller 212 to be opposite the low central cam region 208. When either of the inclined cam surfaces 209 or 210 come into contact with the cam-follower roller 212, then the valve 122 is forced open immediately causing the airgun 20 to cease operation.

Figure 9:
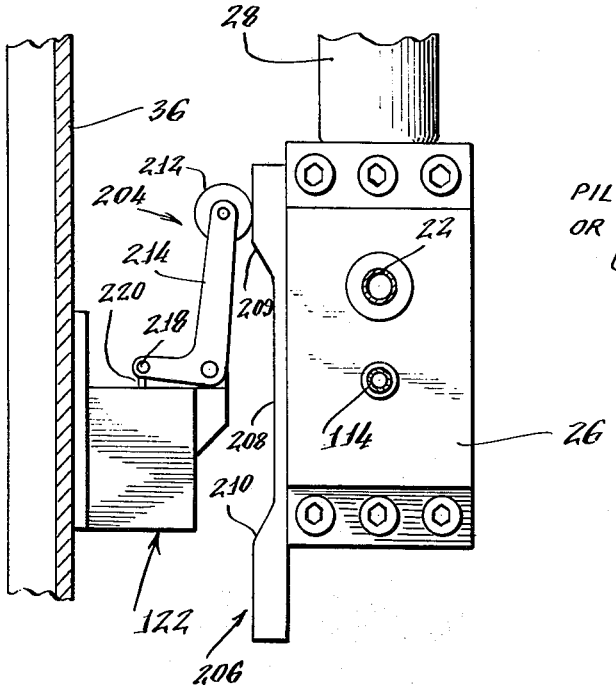
FIGS. 9 and 10 illustrate the position-responsive operation of this valve under different conditions.

As shown in FIG. 9, in the event that the pile which is being driven should suddenly drop or if the operator pulls up on the cable attached to the pile driver eyes 42 (FIGS. 1 and 2), then the roller 212 is moved by the raised cam surface 209 to open the purge and control valve 122, which immediately stops the airgun 20 and stops the pile driver 10. The pile being driven might run into a gas pocket in the sediment under the ocean floor, and such occurrences have been known to allow a driven pile to drop suddenly away from its pile driver. The monitoring means 204 and purge and control valve 122 immediately stop the pile-driving action so as to protect the operating components of the pile driver 10. When the pile driver has been lowered further down so as to re-engage the dropped pile, then the position sensing means 204 allows the valve 122 to become closed so that the pile-driving action can proceed again.

Conversely, the operator may have occassion to raise the pile driver 10, which stops the pile driving action as shown in FIG. 9, as discussed above, thereby to protect the operating components of the pile driver 10.

Figure 10:
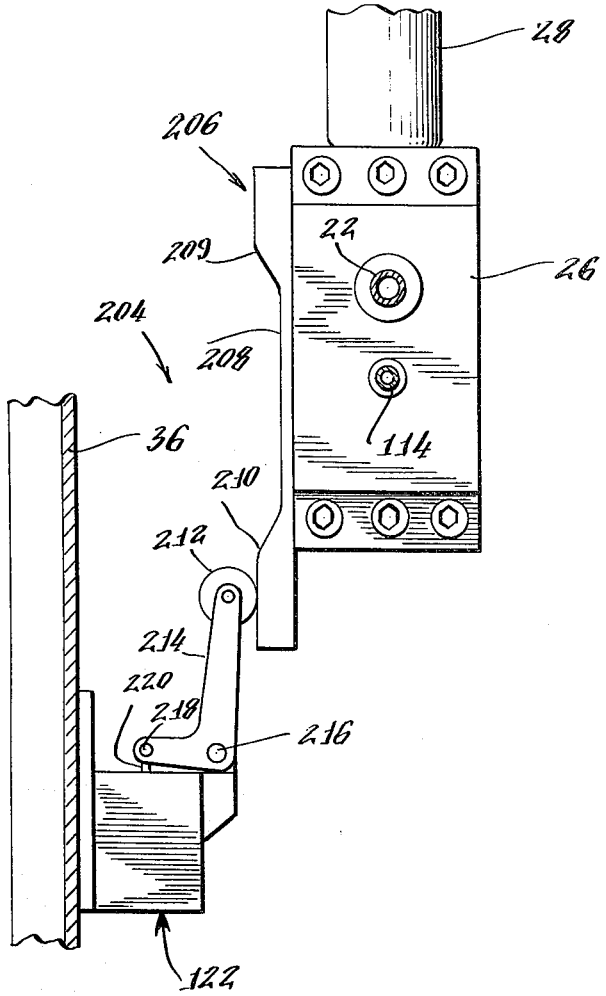

In the event that the shock absorber cylinder 30 should lose an undue amount of fluid, thus allowing the housing 14 to drop below its normal operating position, then as shown in FIG. 10 the lower raised cam surface 210 moves the roller 212 and lever 214 so as to open the purge and control valve 122. Thereby, the pile-driving action is immediately stopped for protecting the operating components of the powerful pile driver 10.

I claim:

1. In a pile driver of the type powered by pressurized gas discharging apparatus and capable of operating partially or totally submerged in water or in air having an elongated cylindrical housing, an elongated cylindrical weight axially movable within the housing, a driving head movably mounted in the housing beneath the weight with pressurized gas discharging apparatus positioned within the housing for suddenly and repeatedly discharging pressurized gas causing the weight to move, the invention comprising an annular cylindrical thrust-transmitting member positioned within the housing intermediate the weight and the driving head, said annular member being secured to said driving head for forming a thrust-transmitting assembly, which is axially movable within the housing, the interior of said thrust-transmitting assembly defining a discharge chamber, pressurized gas discharging apparatus positioned within said thrust-transmitting assembly adapted for suddenly discharging pressurized gas into said discharge chamber therein, shock absorber means for holding said gas discharging apparatus in axially movable relationship relative to said thrust-transmitting assembly, and said thrust-transmitting assembly having an opening extending in a radial direction through its wall for providing communication with the gas discharging apparatus from an area external of the thrust-transmitting assembly, whereby the cylindrical weight and the thrust-transmitting assembly may move axially relative to the gas discharging apparatus.

2. In a pile driver, the invention as claimed in claim 1, in which:

said gas discharging apparatus has an arm rigidly secured thereto and extending in a radial direction through said opening, and said shock absorber means is operatively associated with said arm.

3. In a pile driver, the invention as claimed in claim 2, in which:

said shock absorber means is operatively interposed between the housing of the pile driver and said arm.

4. In a pile driver, the invention as claimed in claim 2, in which:

said shock absorber means is connected to the housing of the pile driver and engages said arm for holding the housing up away from said arm during normal operation.

5. In a pile driver, the invention as claimed in claim 3, in which:

said elongated cylindrical housing of the pile driver has an opening extending therethrough in a radial direction aligned with said opening in the thrust-transmitting assembly, said arms extends radially outwardly through both of said openings to the exterior of said cylindrical housing, and said shock absorber means is positioned exteriorly of said housing and is operatively associated with the outer end of said arm.

6. In a pile driver, the invention as claimed in claim 5, in which:

said shock absorber means includes a cylinder connected to said housing adapted to be filled with a fluid, a movable piston in said cylinder and a piston rod extending from said piston to the outer end of said arm.

7. In a pile driver, the invention as claimed in claim 2, in which:

said arm has a passageway therethrough for feeding pressurized gas into said gas discharging apparatus.

8. In a pile driver of the type powered by pressurized gas discharging apparatus and capable of operating fully submerged, partially submerged or in air and having an elongated cylindrical housing with an elongated cylindrical weight axially movable within the housing, a driving head movably mounted in the housing beneath the weight adapted to be engaged with a pile for driving the pile and with pressurized gas discharging apparatus positioned within the housing for suddenly and repeatedly lifting the weight, the invention comprising an annular member positioned above said driving head and below said movable weight and being connected to said driving head forming a thrust-transmitting assembly with said driving head, said assembly being axially movable within said housing and defining a discharge chamber open at the top with the pressurized gas discharging apparatus being positioned within said discharge chamber, said assembly having an opening in the side thereof, said housing having an opening in the side thereof therein aligned with said opening in said assembly, said gas discharging apparatus having an arm extending therefrom out through both of said openings to the exterior of said cylindrical housing, said arm providing communication with said gas discharging apparatus for feeding pressurized gas thereto, and said gas discharging apparatus being axially movable relative to said assembly.

9. In a pile driver, the invention as claimed in claim 8, in which:

said gas discharging apparatus has a firing chamber therein with a water-purging port communicating with said firing chamber at the bottom thereof, said gas discharging apparatus having a first purging passageway therein extending from said purging port to said arm, and said arm having a purging passageway extending out from said first purging passageway to the exterior of said cylindrical housing, whereby water can be purged from said firing chamber through said port when said gas discharging apparatus is initially being filled with pressurized gas after said pile driver has been submerged into a body of water.

10. In a pile driver, the invention as claimed in claim 8, in which:

said gas discharging apparatus is generally cylindrical in configuration and has a plurality of radial discharge ports all positioned about said apparatus at the same level and has an enlarged diameter portion located below the level of said ports with a reduced diameter portion located about said ports and thereabove for defining an annular clearance space about said ports extending up to the open top of said discharge chamber, and sealing means surrounds said enlarged diameter portion slidably engaging the wall of said discharge chamber for providing a seal below the level of said discharge ports.

11. In a pile driver, the invention as claimed in claim 8, in which:

said opening in the side of said thrust-transmitting assembly closely straddles said arm, and said arm has an upwardly extending projection positioned near to the exterior of said thrust-transmitting assembly for trapping water above said arm and below the top of said opening when said thrust-transmitting assembly is moving downwardly relative to said gas discharging apparatus.

12. In a pile driver, the invention as claimed in claim 9, in which:

said purging passageway extending out through said arm is connected to a valve which has an outlet communicating with the ambient has a movable valve element engageable with a seat for closing said outlet, said valve having spring means normally urging said movable valve element away from its seat, and said movable valve element having piston means exposed to the pressurized gas for closing said element against said seat when the pressure of said pressurized gas exceeds the force of said spring.

13. In a pile driver, the invention as claimed in claim 12, in which:

position-responsive means are provided for sensing the position of said housing of the pile driver relative to the position of said arm for moving said valve element away from said seat when said housing and arm are incorrectly positioned with respect to each other.

14. In a pile driver of the type powered by pressurized gas discharging apparatus and capable of operating fully submerged, partially submerged or in air and having an elongated cylindrical housing with an elongated cylindrical weight axially movable within the housing, a driving head movably mounted in the housing beneath the weight adapted to be engaged with a pile for driving the pile and with pressurized gas discharging apparatus positioned within the housing for suddenly and repeatedly lifting the weight, the invention comprising an annular member positioned above said driving head and below said movable weight forming a thrust-transmitting assembly with said driving head, said assembly being axially movable within said housing and defining a discharge chamber open at the top with the pressurized gas discharging apparatus being positioned within said discharge chamber, said assembly having a radially extending opening in the side thereof, said housing having a radially extending opening in the side thereof aligned with said opening in said assembly, said gas discharging apparatus having an arm rigidly connected thereto and extending therefrom out through both of said openings to the exterior of said cylindrical housing, said arm providing communication with said gas discharging apparatus for feeding pressurized gas thereto, said gas discharging apparatus being axially movable relative to said assembly, and position-responsive control valve means for sensing the position of said housing relative to said arm for releasing the pressurized gas from said discharge apparatus in the event said housing and arm become incorrectly positioned one with respect to the other for stopping the operation of the pile driver in such event.

* * * * *

UNITED STATES PATENT OFFICE

CERTIFICATE OF CORRECTION

Patent No. 3,958,647 Dated May 25, 1976

Inventor(s) Stephen V. Chelminski

It is certified that error appears in the above-identified patent and that said Letters Patent are hereby corrected as shown below:

On the cover sheet, the figure of drawing as shown should be canceled and the figure as shown below substituted therefor.

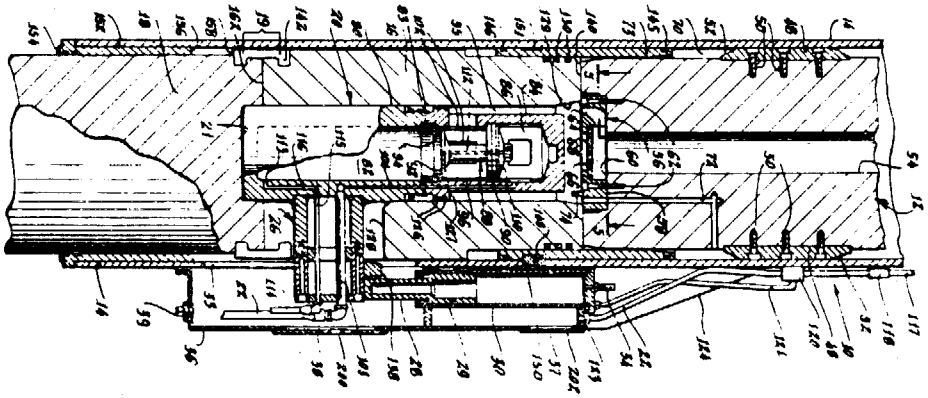

Signed and Sealed this

Fourteenth Day of September 1976

[SEAL]

*Attest:*

RUTH C. MASON
*Attesting Officer*

C. MARSHALL DANN
*Commissioner of Patents and Trademarks*